US007860430B2

(12) United States Patent
Saka

(10) Patent No.: US 7,860,430 B2
(45) Date of Patent: Dec. 28, 2010

(54) IMAGE FORMING APPARATUS HAVING TRANSFER BELT AND CLEANING ARRANGEMENT

(75) Inventor: Yoshihisa Saka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 167 days.

(21) Appl. No.: 12/356,409

(22) Filed: Jan. 20, 2009

(65) Prior Publication Data

US 2009/0185818 A1 Jul. 23, 2009

(30) Foreign Application Priority Data

Jan. 21, 2008 (JP) ..... 2008-010399
Oct. 3, 2008 (JP) ..... 2008-258665

(51) Int. Cl.
*G03G 15/16* (2006.01)

(52) U.S. Cl. ..... 399/101

(58) Field of Classification Search ..... 399/99, 399/101, 102, 302, 303, 312; 198/497
See application file for complete search history.

(56) References Cited

U.S. PATENT DOCUMENTS 4,681,426 A * 7/1987 Bean et al. ..... 399/102
6,374,073 B2 * 4/2002 Ozaki et al. ..... 399/298
6,553,195 B2 * 4/2003 Korfhage et al. ..... 399/102
7,310,488 B2 * 12/2007 Kitamura ..... 399/102
7,400,843 B2 * 7/2008 Nakaya ..... 399/102
7,460,811 B2 * 12/2008 Mochizuki ..... 399/101
7,609,990 B2 * 10/2009 Maeda et al. ..... 399/92
7,720,400 B2 * 5/2010 Taguchi et al. ..... 399/49
2009/0208240 A1 * 8/2009 Saka ..... 399/101

FOREIGN PATENT DOCUMENTS

JP 11161047 A * 6/1999
JP 2005250047 A * 9/2005
JP 2005-338734 12/2005

* cited by examiner

*Primary Examiner*—Robert Beatty
(74) *Attorney, Agent, or Firm*—DLA Piper LLP (US)

(57) ABSTRACT

A transfer device has a cleaning arrangement for preventing any leakage of the toner and the liquid carrier remaining on a transfer belt. The transfer device includes a transfer belt onto which liquid developer images are transferred, the transfer belt being wound around a roller having an axial length of L1, a transfer belt cleaning blade to be brought into contact with the roller by way of the transfer belt, the transfer belt cleaning blade having a length L2 in the axial direction of the roller, and cleaning blade seal members arranged at the opposite lateral ends of the transfer belt cleaning blade in the axial direction of the roller and having a length of L3. The lengths of these members have the relationships of L1>L2 and L1<L2+2L3.

15 Claims, 8 Drawing Sheets

IMAGE FORMING APPARATUS HAVING TRANSFER BELT AND CLEANING ARRANGEMENT

CROSS-REFERENCES TO RELATED APPLICATIONS

This application is based upon and claims the benefit of priority from the prior Japanese Patent Applications No. 2008-10399, filed on Jan. 21, 2008, and No. 2008-258665, filed on Oct. 3, 2008, the entire contents of which are incorporated herein by reference.

BACKGROUND

1. Technical Field

This invention relates to a transfer device for transferring a liquid developer image on an image carrier onto a transfer belt, and to an image forming apparatus including the transfer device.

2. Related Art

Image forming apparatus adapted to use a liquid developer and comprising a transfer unit for transferring the liquid developer image transferred onto a transfer belt further onto a transfer member such as a sheet of paper have been proposed. A transfer device used for such image forming apparatus has a cleaning blade to be brought into contact with the transfer belt after the transfer process to scrape off the toner and the carrier remaining on the transfer belt (refer to, e.g., JP-A-2005-338734).

SUMMARY

However, while the liquid developer scraped off by the cleaning blade is made to flow on the surface of the cleaning blade before it is collected, the liquid developer remaining in the contact area of the cleaning blade and the surface of the transfer belt spreads along the edges of the cleaning blade due to capillarity to produce a belt of liquid referred to as liquid ring, which by turn give rise to defects such as color mixture to the image.

A transfer device according to the present invention dissolves the above-identified problem. In an aspect of the present invention, A transfer device comprising: a transfer belt that carries a transferred image; a roller around which the transfer belt is wound; a transfer belt cleaning blade to be brought into contact with the roller by way of the transfer belt and clean the transfer belt; and a cleaning blade seal member that is arranged at the opposite lateral end of the transfer belt cleaning blade and seal the transfer belt cleaning blade, the roller, the transfer belt cleaning blade and the cleaning blade seal member being arranged to satisfy relationships of $L1>L2$ and $L1<L2+2L3$ ($L1$: a length of the roller in an axial direction, $L2$: a length of the transfer belt cleaning blade in the axial direction, $L3$: a length of the cleaning blade seal member in the axial direction).

The transfer device according to the aspect of the present invention, a meandering preventing member that is arranged at the opposite axial end of the roller and prevent the transfer belt from meandering.

In the transfer device according to the aspect of the present invention, the transfer belt is arranged to satisfy relationships of $L7>L1$, $L7>L2$, and $L7<L2+2L3$ ($L7$: a length of the transfer belt in the axial direction).

The transfer device according to the aspect of the present invention may further include: a transfer belt cleaning roller to be brought into contact with the roller by way of the transfer belt and apply a cleaning bias; a cleaning roller cleaner to be brought into contact with the transfer belt cleaning roller and clean the transfer belt cleaning roller; and a roller cleaner seal member that is arranged at the opposite end of the cleaning roller cleaner in the axial direction of the transfer belt cleaning roller and seal the cleaning roller cleaner, wherein the transfer belt cleaning roller, the cleaning roller cleaner, and the roller cleaner seal member being arranged to satisfy relationships of $L4>L6$, and $L<L6+2L5$ ($L4$: a length of the transfer belt cleaning roller in the axial direction, $L5$: a length of the roller cleaner seal member in the axial direction, $L6$: a length of the cleaning roller cleaner in the axial direction).

In the transfer device according to the aspect of the present invention, the roller cleaner seal member and the cleaning blade seal member are arranged to satisfy a relationship of $L3>L5$.

The transfer device according to the aspect of the present invention has a cleaning support member that supports the transfer belt cleaning blade and the cleaning blade seal member and urges the transfer belt cleaning blade and the cleaning blade seal member to bring them into contact with the transfer belt.

In the transfer device according to the aspect of the present invention, a hardness $H1$ of the transfer belt, a hardness $H2$ of the transfer belt cleaning blade, and a hardness $H3$ of the cleaning blade seal member have relationships of $H2>H1$ and $H1>H3$.

In the transfer device according to the aspect of the present invention, the roller is a tension roller that applies tension to the transfer belt.

In another aspect of the present invention, there is provided an image forming apparatus including: a image carrier drum that carries an image developed by a liquid developer containing toner and carrier liquid; a transfer belt that receives the image as transferred from the image carrier drum; a transfer unit that transfers the image on the transfer belt onto a transfer member; a roller around which the transfer belt is wound; a transfer belt cleaning blade to be brought into contact with the roller by way of the transfer belt and clean the transfer belt; and a cleaning blade seal member that is arranged at the opposite end of the transfer belt cleaning blade and seal the transfer belt cleaning blade; wherein the image carrier drum, the transfer belt, the transfer belt cleaning blade and the cleaning blade seal member being arranged to satisfy relationships of $L8>L7$, $L1>L2$, and $L1<L2+2L3$ ($L1$: a length of the roller in the axial direction, $L2$: a length of the transfer belt cleaning blade in the axial direction, $L3$: a length of the cleaning blade seal member in the axial direction, $L7$: a length of the transfer belt in the axial direction, $L5$: a length of the image carrier drum in the axial direction).

In the image forming apparatus according to the another aspect of the present invention, the transfer belt is arranged to satisfy relationships of $L7>L1$, $L7>L2$ and $L7<L2+2L3$ ($L7$: a length of the transfer belt in the axial direction).

The image forming apparatus according to the another aspect of the present invention may further include: a belt cleaning roller to be brought into contact with the roller by way of the transfer belt and apply a cleaning bias; a cleaning roller cleaner to be brought into contact with the transfer belt cleaning roller and clean the transfer belt cleaning roller; and a roller cleaner seal member that is arranged at the opposite end of the cleaning roller cleaner and seal the cleaning roller cleaner, wherein the transfer belt cleaning roller, the cleaning roller cleaner, the roller cleaner seal member are arranged to satisfy relationships of $L4>L6$, and $L4<L6+2L5$ ($L4$: a length of the transfer belt cleaning roller in the axial direction, $L5$: a length of the roller cleaner seal member in the axial direction, L6: a length of the cleaning roller cleaner in the axial direction).

In the image forming apparatus device according to the another aspect of the present invention, the roller cleaner seal member is arranged to satisfy the relationship of L3>L5.

The image forming apparatus according to the another aspect of the present invention has a cleaning support member that supports the transfer belt cleaning blade and the cleaning blade seal member and urges the transfer belt cleaning blade and the cleaning blade seal member to bring them into contact with the transfer belt.

In the image forming apparatus according to the another aspect of the present invention, a hardness H1 of the transfer belt, a hardness H2 of the transfer belt cleaning blade and a hardness H3 of the cleaning blade seal member have relationships of H2>H1 and H1>H3.

In the image forming apparatus according to the another aspect of the present invention, the roller is a tension roller that applies tension to the transfer belt.

DETAILED DESCRIPTION OF THE PREFERRED EMBODIMENTS

Figure 1:
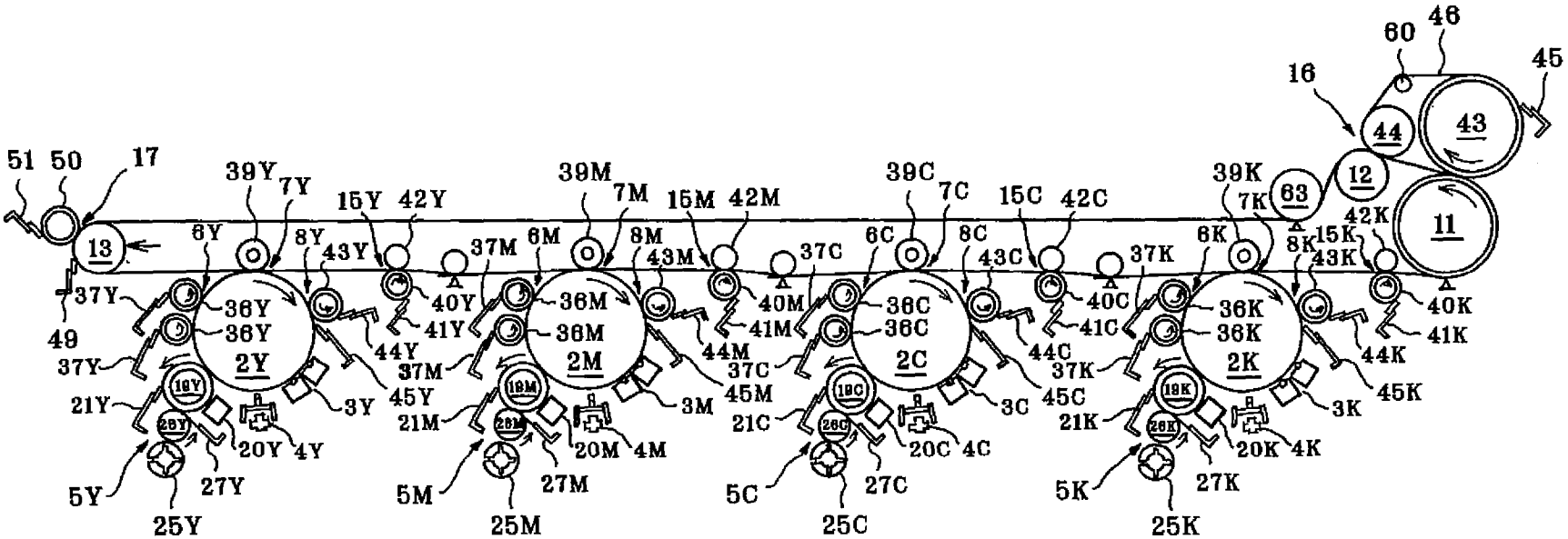
FIG. 1 is a schematic illustration of an embodiment of image forming apparatus according to the present invention having a transfer device according to the present invention, showing principal components thereof.

Now, the present invention will be described in greater detail by referring to the accompanying drawings that illustrate preferred embodiments of the invention. FIG. 1 is a schematic illustration of an embodiment of image forming apparatus according to the present invention having a transfer device according to the present invention, showing principal components thereof.

Referring to FIG. 1, the illustrated embodiment of image forming apparatus 1 includes photosensitive members 2Y, 2M, 2C and 2K that are latent image carriers of yellow (Y), magenta (M), cyan (C) and black (K) arranged one after another, or in tandem Note that 2Y denotes the photosensitive member of yellow and 2M denotes the photosensitive member of magenta while 2C denotes the photosensitive member of cyan and 2K denotes the photosensitive member of black. Also note that other members may be suffixed by Y, M, C or K of the different colors to denote the respective colors to which they are dedicated. In the instance of FIG. 1, the photosensitive members 2Y, 2M, 2C and 2K are image carrier drums. However, the photosensitive members 2Y, 2M, 2C and 2K may alternatively be formed by using so many endless belts.

All the photosensitive members 2Y, 2M, 2C and 2K are arranged so as to rotate clockwise as indicated by arrows in FIG. 1 in operation. Charging members 3Y, 3M, 3C and 3K, exposure units 4Y, 4M, 4C and 4K, development units 5Y, 5M, 5C and 5K, photosensitive member squeezing units 6Y, 6K 6C and 6K, primary transfer units 7Y, 7M, 7C and 7K, photosensitive member cleaning units 8Y, 8M, 8C and 8K are arranged around the respective photosensitive members 2Y, 2M, 2C and 2K in the mentioned order from the upstream side in the sense of rotation.

The image forming apparatus 1 additionally has an endless intermediate transfer belt 10 that is an intermediate transfer medium. The intermediate transfer belt 10 is wound around a belt drive roller 11, to which drive power is transmitted from a motor (not shown), and a pair of follower rollers 12 and 13 so as to rotate counterclockwise in FIG. 1. Note that the belt drive roller 11 and one of the follower rollers, or the follower roller 12, are adjacently arranged with a predetermined gap separating them in the moving direction of the transfer member, which may typically be a sheet of paper, being conveyed and the belt drive roller 11 and the other follower roller 13 are arranged also in the direction of arrangement of the photosensitive members 2Y, 2M, 2C and 2K and significantly separated from each other. The follower roller 13 is urged to a predetermined extent in the direction indicated by an arrow in FIG. 1 so as to prevent the intermediate transfer belt 10 from showing any sag.

Figure 2:
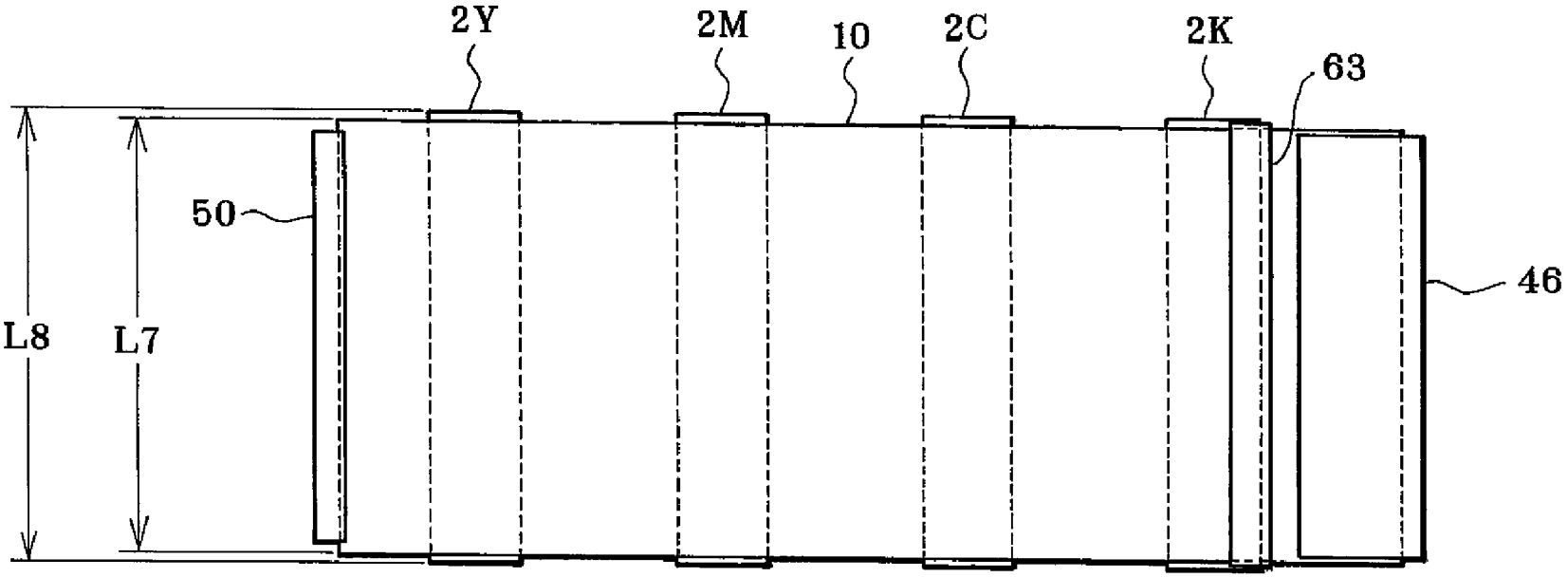
FIG. 2 is a schematic plan view of the embodiment of image forming apparatus having a transfer device of FIG. 1, showing principal component thereof.

The moving direction of the intermediate transfer belt 10 is bent by a holding roller 63 arranged in the vicinity of the follower roller 12. As shown in FIG. 2, the width L7 of the intermediate transfer belt 10 in the axial direction of the photosensitive members is made smaller than the axial length L8 of the photosensitive members 2Y, 2M, 2C and 2K.

Figure 3:
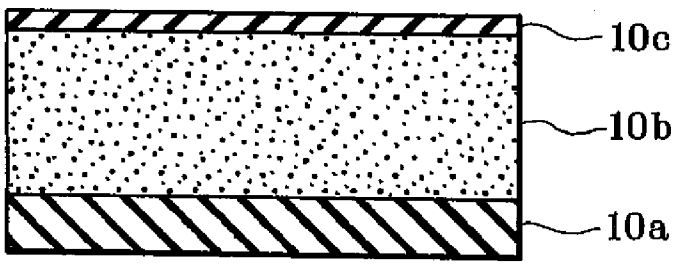
FIG. 3 is a schematic cross-sectional view of the transfer belt of the embodiment of FIG. 1.
Figure 4:
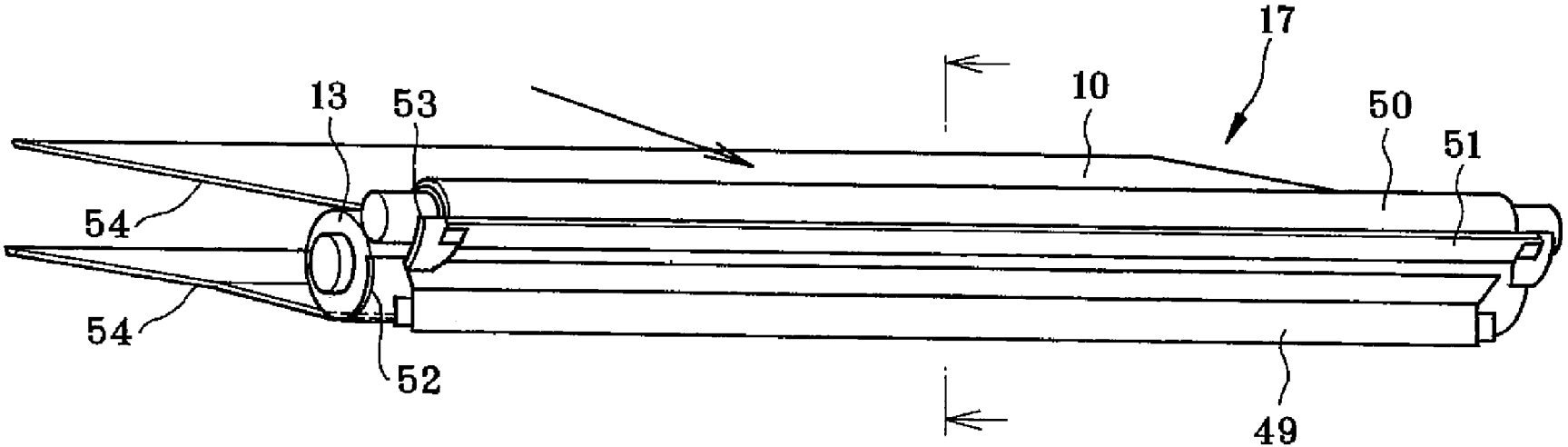
FIG. 4 is a schematic perspective view of the transfer belt cleaning unit of Example 1 of a transfer device according to the present invention.
Figure 5:
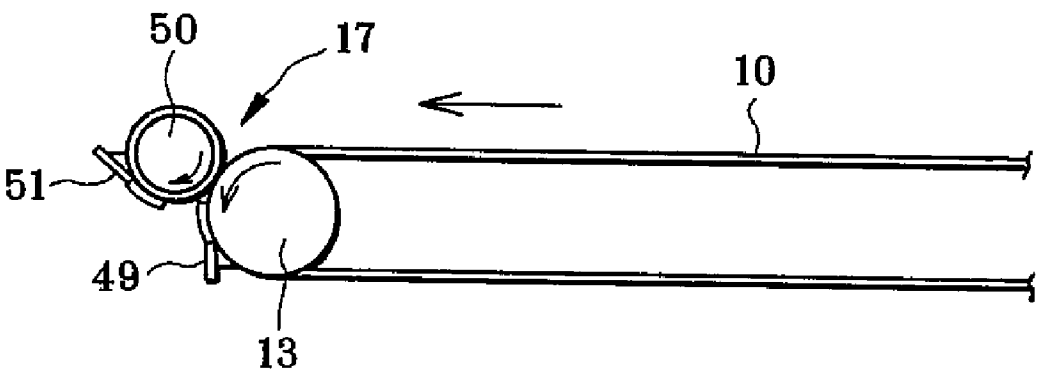
FIG. 5 is a schematic cross-sectional view of the transfer belt cleaning unit of FIG. 4.

As shown in FIG. 3, the intermediate transfer belt 10 has a multilayer structure formed by laying an elastic layer 10*b* on a base member layer 10*a* and forming a coat layer 10*c* on the surface of the elastic layer 10*b*. As a result of forming the intermediate transfer belt 10 to show a multilayer structure having an elastic layer, the intermediate transfer belt 10 is provided with elasticity of an appropriate level in the direction of the thickness thereof so that it operates excellently both when liquid developer images are transferred thereto from the photosensitive members 2Y, 2M, 2C and 2K and when the liquid developer image thereon is transferred onto a transfer member. Particularly, it can transfer an image clearly onto a transfer member having remarkable undulations, even onto recesses of the transfer member. The material of the base member layer 10*a* is polyimide resin, polyamide-imide resin or the like and the thickness of the base member layer is about 100 μm. The material of the elastic layer 10*b* is polyurethane rubber and the hardness thereof if JIS-A30 degrees, while the thickness of the elastic layer 10*b* is 200 μm. The material of the coat layer 10*c* is fluorine resin or the like and the thickness thereof is 10 μm. The volume resistivity of the intermediate transfer belt 10 is about 10-10 Ωcm (the resistivity of all the layers).

While the photosensitive members 2Y, 2M, 2C and 2K and the development units 5Y, 5M, 5C and 5K of the image forming apparatus 1 of this embodiment are arranged in the order of the colors of Y, M, C and K as viewed from the upstream side in the sense of rotation of the intermediate transfer belt 10, the order of arrangement of the colors of Y, M, C and K may be arbitrarily determined.

Intermediate transfer belt squeezing units 15Y, 15M, 15C and 15K are arranged respectively near the primary transfer units 7Y, 7M, 7C and 7K at the downstream side relative to the primary transfer units 7Y, 7M, 7C and 7K in the sense of rotation of the intermediate transfer belt 10. Additionally, the secondary transfer unit 16 is arranged at the side of the belt drive roller 11 of the intermediate transfer belt 10, while an intermediate transfer belt cleaning unit 17 is arranged at the side of the follower roller 13 of the intermediate transfer belt 10.

Although not shown, the image forming apparatus 1 of this embodiment is provided with a transfer member container unit for containing transfer members such as sheets of paper and a resist roller pair for conveying and supplying transfer members to the secondary transfer unit 16 from the transfer member container unit arranged at the upstream side relative to the secondary transfer unit 16 as viewed in the direction of conveying transfer members just as conventional image forming apparatus that involve a secondary transfer process. The image forming apparatus 1 is also provided with a fixing unit and a sheet delivery tray arranged at the downstream side relative to the secondary transfer unit 16 as viewed in the direction of conveying transfer members.

Each of the charging members 3Y, 3M, 3C and 3K is formed by using a pair of corona chargers. A bias voltage showing a polarity same as the polarity of the electric charge of liquid developer is applied to each of the charging members 3Y, 3M, 3C and 3K from a power supply unit (not shown). Thus, the charging members 3Y, 3M, 3C and 3K electrically charge the respective photosensitive members 2Y, 2M, 2C and 2K. The exposure units 4Y, 4M, 4C and 4K respectively form electrostatic latent images on the electrically charged photosensitive members 2Y, 2M, 2C and 2K typically by irradiating a laser beam from a laser scanning optical system.

The development units 5Y, 5M, 5C and 5K are respectively provided with developer supply sections (not shown), development rollers 19Y, 19M, 19C and 19K, toner charging corona chargers 20Y, 20M, 20C and 20K and development roller cleaners 21Y, 21M, 21C and 21K.

The developer supply sections respectively have developer containers for containing liquid developers, each being formed by using toner particles and a non-volatile liquid carrier, developer pumping rollers 25Y, 25M, 25C and 25K, anilox rollers 26Y, 26M, 26C and 26K and developer limiting blades 27Y, 27M, 27C and 27K.

Toner that can be used for the liquid developer contained in each of the developer containers may be particles having an average particle size of 1 μm and prepared by dispersing a known coloring agent, which may be a pigment, into known thermoplastic resin that can be used for toner. On the other hand, a known insulating liquid carrier, for example, Isopar (trademark, available from Exxon), can be used for the liquid carrier when the liquid developer is a low viscosity and low concentration liquid developer, whereas an insulating liquid carrier selected from organic solvents, silicone oils having a firing point not lower than 210° C. such as phenylmethylsiloxane, dimethylpolysiloxane, and polydimethylcyclosiloxane, mineral oils, relatively low viscosity aliphatic saturated hydrocarbons such as liquid paraffin showing a boiling point not lower than 170° C. and a viscosity of 3 mPa·s at 40° C., normal paraffin, vegetable oils, edible oils, higher fatty acid esters can be used for the liquid carrier when the liquid developer is a high viscosity and high concentration developer. Each of the liquid developers 23Y, 23M, 23C and 23K is prepared by adding toner particles to a liquid carrier with a dispersant to make the solid concentration of the toner equal to about 20%.

The developer pumping rollers 25Y, 25M, 25C and 25K respectively pump up the liquid developers in the developer containers and supply them to the anilox rollers 26Y, 26M, 26C and 26K. The developer pumping rollers 25Y, 25M, 25C and 25K are driven to rotate clockwise in FIG. 1 as indicated by arrows. Each of the anilox rollers 26Y, 26M, 26C and 26K is prepared by forming fine and uniform spiral grooves on the surface of a cylindrical member. The grooves are arranged at a pitch of about 170 μm and with a depth of about 30 μm, although other values may be selected for the pitch and the depth of the grooves. The anilox rollers 26Y, 26M, 26C and 26K are driven to rotate counterclockwise as indicated by respective arrows in FIG. 1, or in the sense of rotation same as that of the development rollers 19Y, 19M, 19C and 19K. However, the anilox rollers 26Y, 26M, 26C and 26K may be driven to rotate by the respective rotary motions of the development rollers 19Y, 19M, 19C and 19K. In other words, the sense of rotation of the anilox rollers 26Y, 26M, 26C and 26K is not limited and may be arbitrarily selected.

The developer limiting blades 27Y, 27M, 27C and 27K are arranged respectively so as to be held in contact with the surfaces of the anilox rollers 26Y, 26M, 26C and 26K. Each of the developer liming blades 27Y, 27M, 27C and 27K is formed by a rubber section (made of urethane rubber) that is held in contact with the corresponding one of the anilox rollers 26Y, 26M, 26C and 26K and a plate that is made of metal to support the rubber section. The developer limiting blades 27Y, 27M, 27C and 27K respectively scrape off and remove the liquid developers adhering to the surfaces of the anilox rollers 26Y, 26M, 26C and 26K except those in the grooves. Therefore, the anilox rollers 26Y, 26M, 26C and 26K respectively supply only the liquid developers adhering to the inside of the grooves to the development rollers 19Y, 19M, 19C and 19K.

The development rollers 19Y, 19M, 19C and 19K are cylindrical members that are about 320 mm wide. Each of the developer rollers 19Y, 19M, 19C and 19K has an elastic member typically made of conductive urethane rubber, a resin layer and a rubber layer arranged on the outer periphery of a metal shaft typically made of iron. The developer rollers 19Y, 19M, 19C and 19K are respectively held in contact with the photosensitive members 2Y, 2M, 2C and 2K and driven to rotate counterclockwise in FIG. 1 as indicated by respective arrows in FIG. 1.

A predetermined voltage is applied to the toner charging corona chargers 20Y, 20M, 20C and 20K so as to respectively charge the corresponding development rollers 19Y, 19M, 19C and 19K.

The development roller cleaners 21Y, 21M, 21C and 21K are made of rubber and respectively held in contact with the surfaces of the development rollers 19Y, 19M, 19C and 19K to scrape off and remove the developers remaining on the development rollers 19Y, 19M, 19C and 19K.

The photosensitive member squeezing units 6Y, 6M, 6C and 6K respectively have pairs of photosensitive squeezing rollers 36Y, 36M, 36C and 36K and photosensitive member squeezing roller cleaners 37Y, 37M, 37C and 37K. The photosensitive member squeezing rollers 36Y, 36M, 36C and 36K are respectively arranged downstream relative to the contact sections (nip sections) of the photosensitive members 2Y, 2M, 2C and 2K and the development rollers 19Y, 19M, 19C and 19K in the sense of rotation. The photosensitive member squeezing rollers 36Y, 36M, 36C and 36K are driven to rotate in the sense opposite to the sense of rotation of the photosensitive members 2Y, 2C, 2M and 2K (counterclockwise in FIG. 1) to remove the liquid carrier on the photosensitive members 2Y, 2M, 2C and 2K.

Each of the photosensitive member squeezing rollers 36Y, 36M, 36C and 36K is preferably an elastic roller formed by sequentially arranging an elastic member typically made of conductive urethane rubber and a fluorine resin layer on the surface of a metal core shaft. Each of the photosensitive member squeezing roller cleaners 37Y, 37M, 37C and 37K is preferably an elastic member typically made of rubber. The photosensitive member squeezing roller cleaners 37Y, 37M, 37C and 37K are respectively held in contact with the corresponding photosensitive member squeezing rollers 36Y, 36M, 36C and 36K to scrape off and remove the liquid carrier remaining on the squeezing rollers 36Y, 36M, 36C and 36K.

The primary transfer units 7Y, 7M, 7C and 7K are respectively provided with primary transfer backup rollers 39Y, 39M, 39C and 39K for bringing the intermediate transfer belt 10 into contact with the photosensitive members 2Y, 2M, 2C and 2K. A voltage, e.g. −200V, showing the polarity opposite to that of the electric charge of toner particles is applied to the backup rollers 39Y, 39M, 39C and 39K in order to transfer the toner images (liquid developer images) of the different colors on the photosensitive members 2Y, 2M, 2C and 2K onto the intermediate transfer belt 10 for primary transfers.

The photosensitive member cleaning units 8Y, 8M, 8C and 8K respectively include photosensitive member cleaning rollers 43Y, 43M, 43C and 43K, photosensitive member cleaning roller cleaners 44Y, 44M, 44C and 44K and photosensitive member cleaning blades 45Y, 45M, 45C and 45K, which are arranged downstream relative to the respective photosensitive members 2Y, 2M, 2C and 2K after each primary transfer.

The intermediate transfer belt squeezing units 15Y, 15M, 15C and 15K respectively include intermediate transfer belt squeezing rollers 40Y, 40M, 40C and 40K, intermediate transfer belt squeezing backup rollers 42Y, 42M, 42C and 42K and intermediate transfer belt squeezing roller cleaners 41Y, 41M, 41C and 41K. The intermediate transfer belt squeezing rollers 40Y, 40M, 40C and 40K respectively collect the liquid carrier of the corresponding colors on the intermediate transfer belt 10. The intermediate transfer belt squeezing roller cleaners 41Y, 41M, 41C and 41K respectively scrape off the collected liquid carrier on the intermediate transfer belt squeezing rollers 40Y, 40M, 40C and 40K. Like the squeezing roller cleaners 37Y, 37M, 37C and 37K, each of the intermediate transfer belt squeezing roller cleaners 41Y, 41M, 41C and 41K is formed by using an elastic member typically made of rubber.

The intermediate transfer belt cleaning unit 17 arranged at the side of the follower roller 13 of the intermediate transfer belt 10 includes an intermediate transfer belt cleaning roller 50, intermediate transfer belt cleaning roller cleaner 51 and an intermediate transfer belt cleaning blade 49. A bias is applied to the intermediate transfer belt cleaning roller 50 so that the intermediate transfer belt cleaning roller 50 removes solid on the intermediate transfer belt 10 by electrostatic adsorption. The intermediate transfer belt cleaning blade 49 arranged downstream relative to the intermediate transfer belt cleaning roller 50 scrapes off and removes the toner remaining on the intermediate transfer belt 10.

The secondary transfer unit 16 includes a pair of secondary transfer rollers arranged in the moving direction of transfer members and separated from each other by a predetermined gap. Of the pair of secondary transfer rollers, the secondary transfer roller arranged upstream in the moving direction of transfer members is the first secondary transfer roller 43. Of the pair of secondary transfer rollers, the secondary transfer roller arranged downstream in the moving direction of transfer members is the second secondary transfer roller 44. An endless transfer belt 46 is wound around the first and second secondary transfer rollers 43 and 44. Tension is applied to the transfer belt 46 by a tension roller 60. The first and second secondary transfer rollers 43 and 44 can be respectively brought into contact with the belt drive roller 11 and the follower roller 12 by way of the intermediate transfer belt 10 and the transfer belt 46. The transfer belt 46 is made of polyimide resin or polyamide-imide resin.

Thus, the transfer belt 46 wound around the secondary transfer rollers 43 and 44 makes a transfer member tightly adhere to the intermediate transfer belt 10 wound around the belt drive roller 11 and the follower roller 12 and transfers the full color toner image (liquid developer image) on the intermediate transfer belt 10 formed by laying toner images of the different colors one on the other onto the transfer member for a secondary transfer, while conveying the transfer member in a state of tightly adhering to the intermediate transfer belt 10.

In the above-described arrangement, the belt drive roller 11 and the follower roller 12 respectively operate as backup rollers of the secondary transfer rollers 43 and 44 for secondary transfers. More specifically, the belt drive roller 11 also operates as the first backup roller arranged upstream relative to the follower roller 12 in the moving direction of the transfer member in the secondary transfer unit 16 and the follower roller 12 also operates as the second backup roller arranged downstream relative to the belt drive roller 11 in the moving direction of the transfer member in the secondary transfer unit 16.

Therefore, the transfer member that is conveyed to the secondary transfer unit 16 is made to tightly adhere to the intermediate transfer belt 10 in the predetermined moving range of transfer member between the pressure-contact starting position (nip-starting position) of the first secondary transfer roller 43 and the belt drive roller 11 to the pressure-contact ending position (nip-ending position) of the second secondary transfer roller 44 and the follower roller 12. As a result, the full color toner image on the intermediate transfer belt 10 is transferred onto the transfer member for a secondary transfer in a predetermined period of time under a condition where it is tightly adhering to the intermediate transfer belt 10. Thus, the net result will be an excellent secondary transfer.

The secondary transfer unit 16 also includes a transfer belt cleaner 45 for the transfer belt 46. Like the photosensitive member squeezing roller cleaners 37Y, 37M, 37C and 37K, the transfer belt cleaner 45 is an elastic member typically made of rubber. The transfer belt cleaner 45 is held in contact with the transfer belt 46 to scrape off and remove the foreign objects such as the liquid developers remaining on the surface of the transfer belt 46 after a secondary transfer. Thus, the foreign objects such as the liquid developers adhering to the transfer belt 46 are prevented from adversely affecting the next transfer member.

Additionally, the first secondary transfer roller 43 can be brought into contact with the belt drive roller 11 by way of the intermediate transfer belt 10 and the transfer belt 46. Then, the transfer member is made to reliably and tightly adhere to the intermediate transfer belt 10 when it gets into the pressure-contact position of the belt drive roller 11 and the first secondary transfer roller 43. Thus, as a result, the operation of transferring the liquid developer image from the intermediate transfer belt 10 onto the transfer member is reliably started. Additionally, since the transfer member coming out from the pressure-contact position of the belt drive roller 11 and the first secondary transfer roller 43 is pinched between the intermediate transfer belt 10 and the transfer belt 46, the transfer member is prevented from being peeled off (lifting) from the intermediate transfer belt 10. Therefore, the operation of transferring the liquid developer image can be conducted further satisfactorily. Still additionally, the transfer belt 46 is made to run in parallel with the intermediate transfer belt 10 between the contact position of the first secondary transfer roller 43 and the belt drive roller 11 and the contact position of the second secondary transfer roller 44 and the follower roller 12. Thus, as a result, the transfer member is made to stably and tightly adhere to the intermediate transfer belt 10 while the transfer member moves between the contact positions Therefore, the transfer efficiency is further raised and the transfer member conveying performance is further improved.

When the transfer member starts getting into the pressure-contact position of the belt drive roller 11 and the first secondary transfer roller 43 and also when it starts getting into the pressure-contact position of the follower roller 12 and the second secondary transfer roller 44, both the intermediate transfer belt 10 and the transfer belt 46 are apt to become slack because of the resistance of the transfer member For this reason, the follower roller 13 is made to operate also as tension roller for the intermediate transfer belt 10, applying tension to the latter, while a tension roller 60 is arranged to apply tension to the transfer belt 47. With this arrangement, both the intermediate transfer belt 10 and the transfer belt 46 are held under tension if the intermediate transfer belt 10 and the transfer belt 46 try to become slack because of the resistance of the transfer member as described above. Therefore, the full color image on the intermediate transfer belt 10 is efficiently transferred onto the transfer member between the pressure-contact position of the belt drive roller 11 and the first secondary transfer roller 43 and the pressure-contact position of the follower roller 12 and the second secondary transfer roller 44. Additionally, the transfer member is supported and conveyed by the transfer belt 46 further stably and reliably.

FIGS. 4 through 7 are schematic illustrations of a transfer device according to the present invention and having an intermediate transfer belt cleaning unit 17 of Example 1.

The transfer device having the intermediate transfer belt cleaning unit 17 of Example 1 is arranged at the side of the follower roller 13 that operates as tension roller for applying tension to the intermediate transfer belt 10 in order to remove the liquid developers remaining on the intermediate transfer belt 10 after a secondary transfer. A bead 54 is bonded to at least one of the lateral edges of the intermediate transfer belt 10 at the rear surface side thereof as meandering adjusting member, the intermediate transfer belt 10 having a width L7 of 374 mm in the axial direction of the photosensitive members. The bead 54 is made of urethane rubber and has a thickness of 1.5 mm and a width of 5.5 mm.

The follower roller 13 wound by the intermediate transfer belt 10 has a roller main body formed by arranging an anti-slip surface layer of urethane rubber around a core shaft to show an outer diameter of 33.4 mm and an axial length L1 of 367 mm and shaft sections extending from the opposite ends of the roller main body and having a diameter smaller than that the roller main body.

Figure 6:
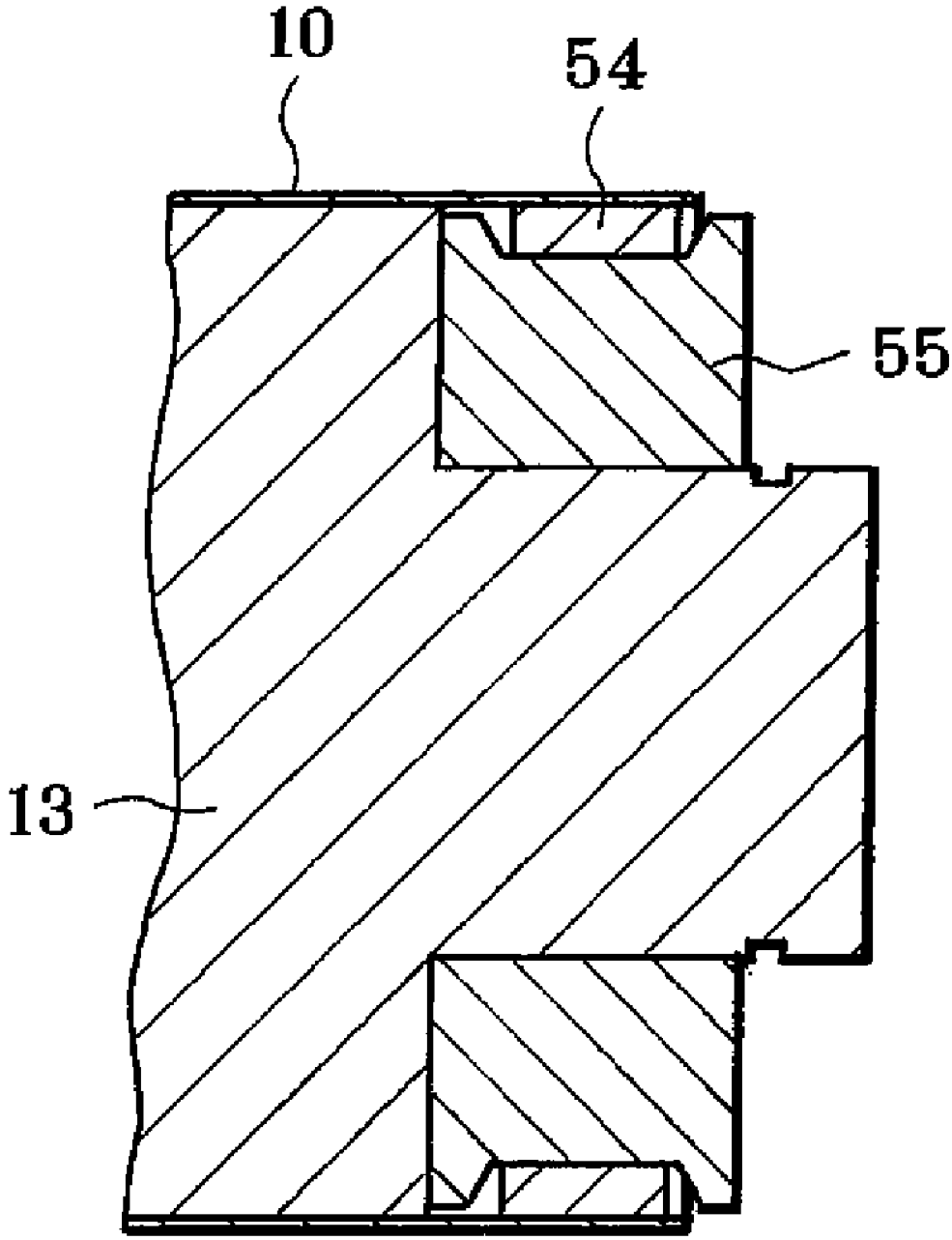
FIG. 6 is a schematic partial cross-sectional view of an end of the roller wound by the transfer belt of the transfer belt cleaning unit of FIG. 4.
Figure 7B:
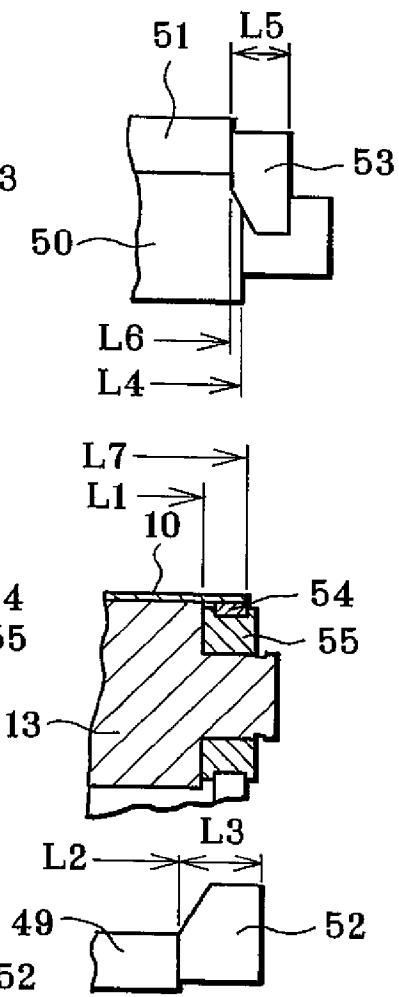
FIGS. 7A and 7B are schematic illustrations of the relationship of the lengths of the components of the transfer belt cleaning unit of FIG. 4.
Figure 7A:
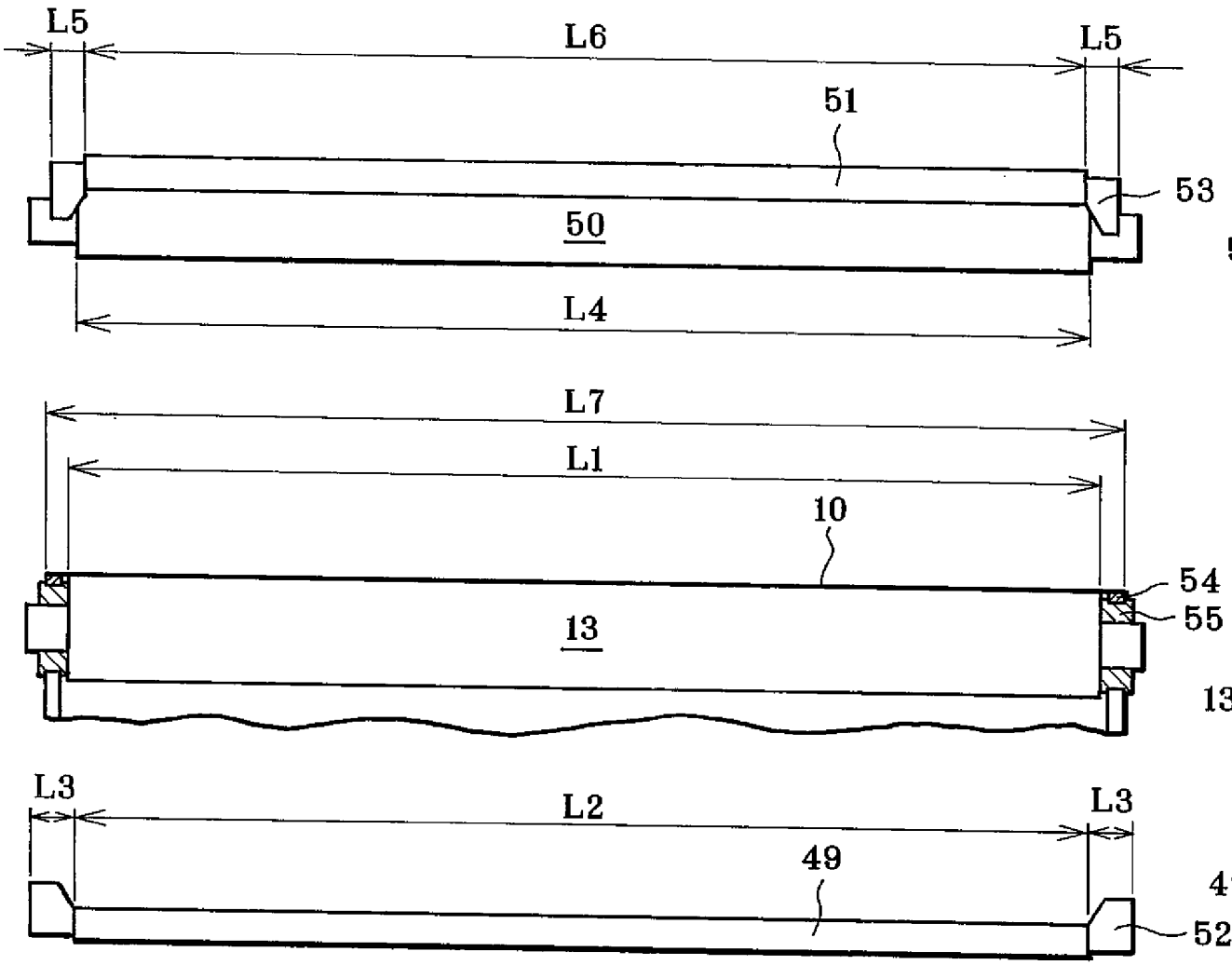
Figure 8:
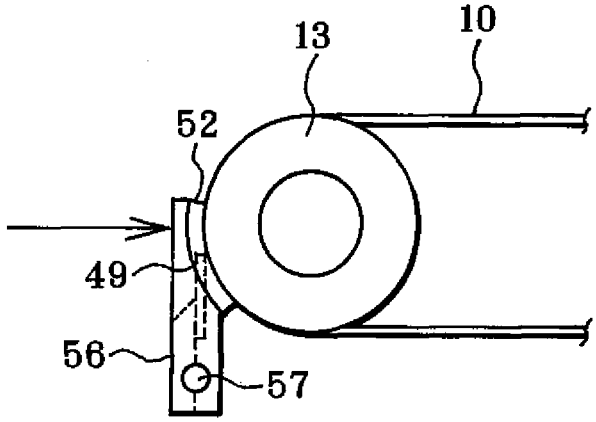
FIG. 8 is a schematic cross-sectional view of the transfer belt cleaning unit of Example 2 of a transfer device according to the present invention.
Figure 9:
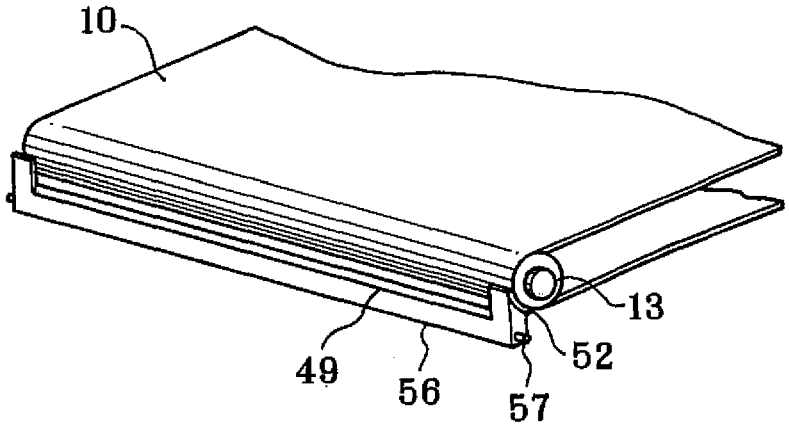
FIG. 9 is a schematic perspective view of the transfer belt cleaning unit of FIG. 8.
Figure 10:
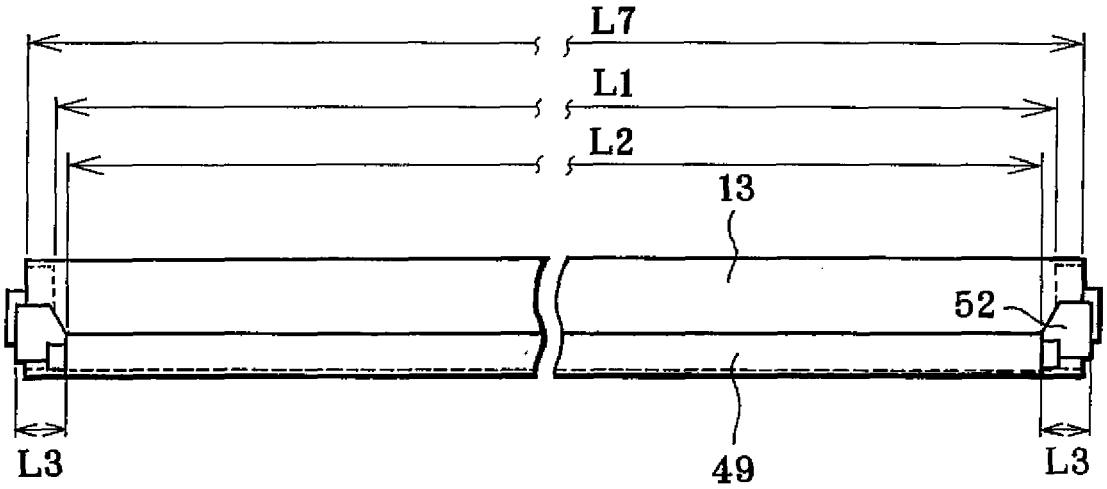
FIG. 10 is a schematic illustration of the relationship of the lengths of the components of the of transfer belt cleaning unit of FIG. 8.
Figure 11:
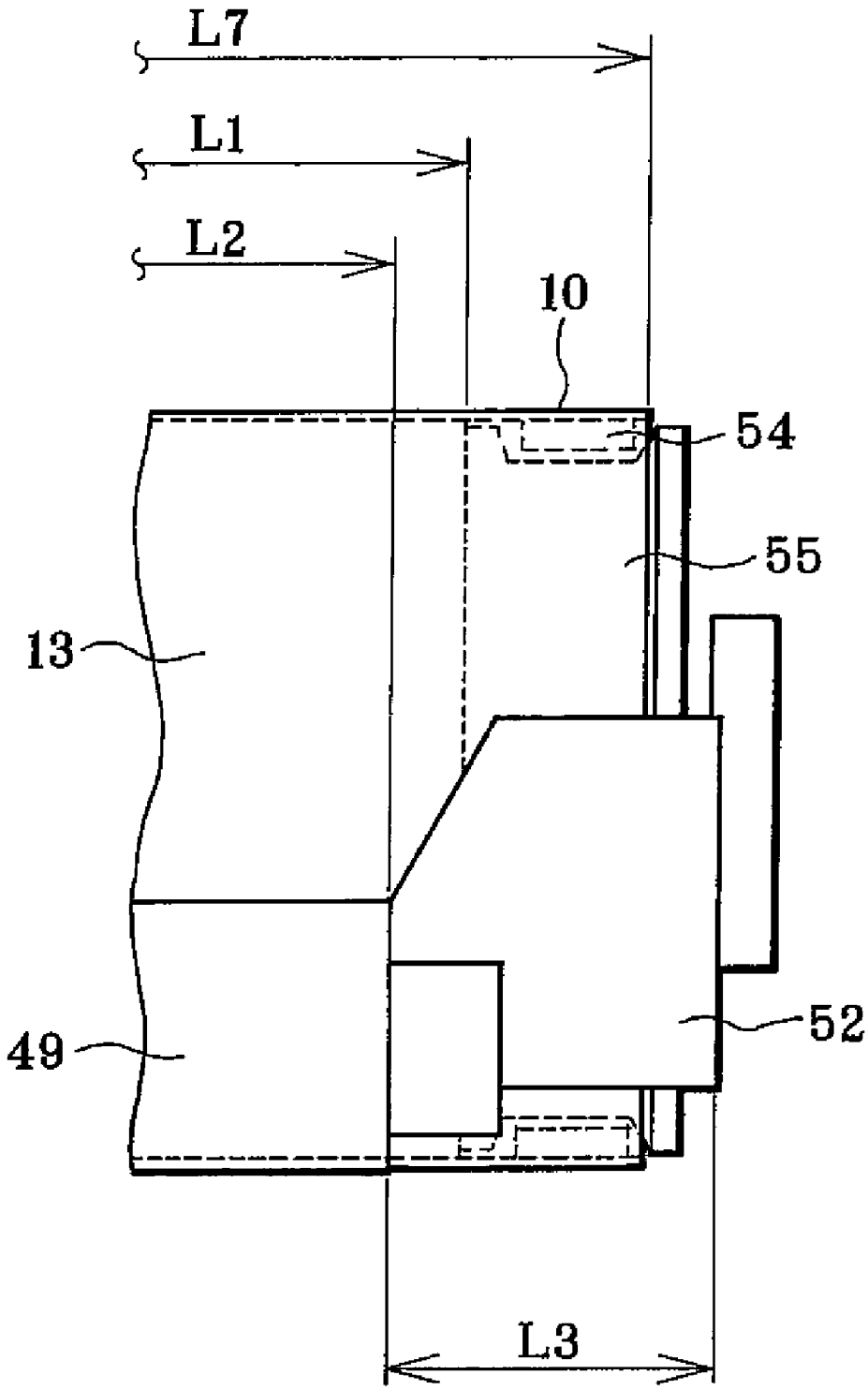
FIG. 11 is a schematic cross-sectional view of an end of the transfer belt cleaning unit of FIG. 8.

As shown in FIGS. 6 and 7, pulleys 55 are rotatably fitted onto the respective smaller diameter shaft sections of the follower roller 13 as meandering preventing members. Each of the pulleys 55 has a groove that is 6.3 to 7.4 mm wide and 1.5 mm deep for guiding the bead 54 bonded to the corresponding lateral edge of the intermediate transfer belt 10 at the rear surface side thereof. The opposite lateral sides of the groove are tapered in order to reduce the contact friction of the pulley with the bead 54 at the groove. The pulleys 55 have an outer diameter of 32.7 mm, which is smaller than the outer diameter of 33.4 mm of the roller main body of the follower roller 13 so that the pulleys 55 are prevented from contacting the intermediate transfer belt 10.

The transfer device having the intermediate transfer belt cleaning unit 17 of Example 1 includes an intermediate transfer belt cleaning roller 50 held in contact with the follower roller 13 by way of the intermediate transfer belt 10, an intermediate transfer belt cleaning roller cleaner 51 brought into contact with the intermediate transfer belt cleaning roller 50 and an intermediate transfer belt cleaning blade 49 to be brought into contact with the follower roller 13 by way of the intermediate transfer belt 10 at a position downstream relative to the intermediate transfer belt cleaning roller 50

The intermediate transfer belt cleaning roller 50 is formed by arranging an urethane rubber layer showing a hardness of JIS-A30 degrees around a core shaft to a thickness of 2.5 mm and then arranging an urethane coat layer showing a hardness of JIS-A60 degrees thereon to a thickness of 100 μm so as to make the intermediate transfer belt cleaning roller 50 show a diameter of 25 mm and an axial length L4 of 352 mm. The intermediate transfer belt cleaning roller 50 is driven to rotate at a peripheral speed same as the moving speed of the intermediate transfer belt 10 in the sense of rotation same as the moving direction of the intermediate transfer belt 10. A voltage of about 400V is applied to the intermediate transfer belt cleaning roller 50 to remove solid such as toner from the surface of the intermediate transfer belt 10 by electrostatic adsorption. The resistivity of the intermediate transfer belt cleaning roller 50 is typically 10-4Ω.

The intermediate transfer belt cleaning roller cleaner 51 is brought into contact with the intermediate transfer belt cleaning roller 50 so as to counter the rotary motion of the intermediate transfer belt cleaning roller 50. The intermediate transfer belt cleaning roller cleaner 51 is made of urethane rubber showing a hardness of JIS-A90 degrees, which is higher than the hardness of the intermediate transfer belt cleaning roller 50, or JIS-30 degrees The intermediate transfer belt cleaning roller cleaner 51 has a thickness of 2 mm, a free length of 6.5 mm, an axial length L6 of 384 mm. Since the intermediate transfer belt cleaning roller cleaner 51 shows a hardness higher than that of the intermediate transfer belt cleaning roller 50, it can efficiently clean the surface of the intermediate transfer belt cleaning roller 50. While the contact angle of the intermediate transfer belt cleaning roller cleaner 51 relative to the peripheral surface of the intermediate transfer belt cleaning roller 50 is not subjected to any particular limitations, an excellent cleaning effect could be achieved when the intermediate transfer belt cleaning roller cleaner 51 was brought into contact with the intermediate transfer belt cleaning roller 50 at a contact angle of 20° under contact pressure of 1.2 kgf.

Cleaning roller seal members 53 are fitted to the opposite lateral ends of the intermediate transfer belt cleaning roller cleaner 51. The cleaning roller seal members 53 are made of PORON ML-32 available from INOAC Corporation (hardness: not greater than 10 degrees when reduced to JIS-A). The cleaning roller seal members 53 have an axial length L5 of 11 mm and a thickness of 3 mm. The carrier absorption performance of the intermediate transfer belt cleaning roller cleaner 51 at the opposite lateral ends can be improved by making the cleaning roller seal members 53 operate as oil absorbing members. The cleaning roller seal members 53 are made to extend upstream from the contact position of the intermediate transfer belt cleaning roller cleaner 51 and the intermediate transfer belt cleaning roller 50 in the sense of rotation of the latter and the upstream extensions of the cleaning roller seal members 53 are tapered at the side of the intermediate transfer belt cleaning roller cleaner 51 to prevent any liquid ring from appearing.

The axial length L4 of the intermediate transfer belt cleaning roller 50, the axial length L6 of the intermediate transfer belt cleaning roller cleaner 51 and the axial length L5 of the cleaning roller seal members 53 show the relationships of L4>L6 and L4<L6+2L5. The cleaning roller seal members 53 efficiently clean the intermediate transfer belt cleaning roller 50 at the opposite ends of the latter.

Te hardness H4 of the intermediate transfer belt cleaning roller 50, the hardness H5 of the intermediate transfer belt cleaning roller cleaner 51 and the hardness L6 of the cleaning roller seal members 53 show the relationships of H5>H4 and H4>H6. The intermediate transfer belt cleaning roller cleaner 51 cleans the surface of the intermediate transfer belt cleaning roller 50 by means of its blade, while the cleaning roller seal members 53 are pushed and deformed so as to tightly adhere to the opposite ends of the intermediate transfer belt cleaning roller 50 so that they prevent any liquid leakage from taken place there and clean the opposite ends.

The intermediate transfer belt cleaning blade 49 is brought into contact with the follower roller 13 via the intermediate transfer belt 10 at a position downstream relative to the intermediate transfer belt cleaning roller 50. The intermediate transfer belt cleaning blade 49 is made of urethane rubber showing a hardness H2 equal to JIS-A90 degrees, which is higher than the hardness H1 of the intermediate transfer belt 10 and has a thickness of 2 mm, a free length of 6.5 mm and a length L6 of 351 mm. The intermediate transfer belt cleaning blade 49 is brought into contact with the follower roller 13 so as to counter the rotary motion of the latter. While the contact angle of the intermediate transfer belt cleaning blade 49 relative to the peripheral surface of the follower roller 13 is not subjected to any particular limitations, an excellent cleaning effect could be achieved when the intermediate transfer belt cleaning blade 49 was brought into contact with the follower roller 13 at a contact angle of 20° under contact pressure of 1.2 kgf.

As seen from FIG. 2, the axial length L8 of the photosensitive members 2Y, 2M, 2C and 2K is greater than the width L7 of the intermediate transfer belt 10 in the axial direction of the photosensitive members and therefore the intermediate transfer belt 10 needs to be cleaned well at the opposite ends thereof in order to prevent color mixing from taking place there. Additionally, while the liquid developer scraped off by the intermediate transfer belt cleaning blade 49 flows on the surface of the intermediate transfer belt cleaning blade 49 before they are collected, the liquid developer staying in the contact section of the intermediate transfer belt cleaning blade 49 and the surface of the intermediate transfer belt 10 can spread to the opposite lateral ends of the intermediate transfer belt cleaning blade 49 due to the capillarity to produce a belt of liquid referred to as liquid ring, which by turn give rise to defects such as color mixture to the image.

To cope with this problem, cleaning blade seal members 52 are respectively fitted to the opposite ends of the intermediate transfer belt cleaning blade 49. The cleaning blade seal members 52 are made of PORON ML-32 available from INOAC Corporation (hardness: not greater than 10 degrees when reduced to JIS-A). The effect of absorbing the liquid carrier at the opposite ends of the intermediate transfer belt cleaning blade 49 can be improved when the cleaning blade seal members 52 are made to operate as oil absorbing members. The cleaning blade seal members 52 have an axial length L3 of 15 mm and a thickness of 3 mm. The axial length L3 of the cleaning blade seal members 52 is greater than the axial length L5 of the cleaning roller seal members 53 because solid that does not show any significant fluidity is mainly removed by the intermediate transfer belt cleaning roller 50 and hence no problem arises when the axial length L5 of the roller cleaner seal members 53 is made smaller than the axial length L3 of the cleaning blade seal members 52 that mainly remove liquid. Each of the cleaning blade seal members 52 is made to extend upstream from the contact position of the intermediate transfer belt cleaning blade 49 and the intermediate transfer belt 10 in the sense of rotation of the intermediate transfer belt 10 and the extending part is tapered at the side thereof close to the intermediate transfer belt cleaning blade 49 to prevent any liquid ring from being produced.

The axial length L2 of the intermediate transfer belt cleaning blade 49, the axial length L1 of the follower roller 13, the axial length L7 of the intermediate transfer belt 10 and the axial length L3 of the cleaning blade seal members 52 are made to show the relationships of L1>L2, L1<L2+2L3, L7>L1, L7>L2 and L7<L2+2L3. The intermediate transfer belt cleaning blade 49 can be pressed strongly against the intermediate transfer belt 10 to improve the cleaning effect by using the follower roller 13 as backup roller when L1>L2. Any liquid ring is prevented from being produced at the ends of the intermediate transfer belt cleaning blade 49 and any liquid carrier is prevented from flowing to the rear surface side of the intermediate transfer belt 10 to consequently prevent color mixing from taking place when L1<L2+2L3. Additionally, the liquid carrier and the toner at the opposite edges of the intermediate transfer belt 10 where no backup roller is provided can be removed when L7>L1, L7>L2 and L7<L2+2L3.

The hardness H1 of the intermediate transfer belt 10, the hardness H2 of the intermediate transfer belt cleaning blade 49 and the hardness H3 of the cleaning blade seal members 52 are made to show the relationships of H2>H1 and H1>H3. With this arrangement, the cleaning blade seal members 52 are pressed and deformed to tightly adhere to the opposite ends of the intermediate transfer belt 10 where no backup roller is provided to prevent any leakage of liquid and clean the opposite ends, while the intermediate transfer belt cleaning blade 49 cleans the surface of the intermediate transfer belt 10 by means of its edge.

The lengths and the widths of the component members of the transfer device having the intermediate transfer belt cleaning unit 17 of Example 1 are listed in Table 1 below.

TABLE 1

| Member | Axial length or width |
|---|---|
| follower roller L1 | 367 mm |
| intermediate transfer belt cleaning blade L2 | 351 mm |

TABLE 1-continued

| Member | Axial length or width |
|---|---|
| cleaning blade seal members L3 | 15 mm |
| intermediate transfer belt cleaning roller L4 | 352 mm |
| cleaning roller seal members L5 | 11 mm |
| intermediate transfer belt cleaning roller cleaner L6 | 348 mm |
| intermediate transfer belt L7 | 374 mm |

FIGS. 8 through 11 are schematic illustrations of a transfer device according to the present invention and having an intermediate transfer belt cleaning unit 17 of Example 2.

The transfer device having the intermediate transfer belt cleaning unit 17 of Example 2 is not provided with an intermediate transfer belt cleaning roller 50, while the transfer device having the intermediate transfer belt cleaning unit 17 of Example 1 is provided with an intermediate transfer belt cleaning roller 50. In Example 2, pulleys 55 are rotatably fitted onto the respective smaller diameter shaft sections of the follower roller 13 as meandering preventing members. Each of the pulleys 55 has a groove that is 6.3 to 7.4 mm wide and 1.5 mm deep for guiding the bead 54 bonded to the corresponding lateral edge of the intermediate transfer belt 10 at the rear surface side thereof as meandering adjusting member. The opposite lateral sides of the groove are tapered in order to reduce the contact friction of the pulley with the bead 54 at the groove. The pulleys 55 have an outer diameter of 32.7 mm, which is smaller than the outer diameter of 33.4 mm of the roller main body of the follower roller 13 so that the pulleys 55 are prevented from contacting the intermediate transfer belt 10.

In Example 2, the intermediate transfer belt cleaning blade 49 and the cleaning blade seal members 52 are supported by a cleaning support member 56 that is made of metal. The cleaning support member 56 is by turn rotatably supported by pins 57 such that it can be removably brought into contact with the intermediate transfer belt 10. The cleaning support member 56 is provided with an urging means (not shown) such as a spring to press the intermediate transfer belt cleaning blade 49 and the cleaning blade seal members 52 against the surface of the intermediate transfer belt 10.

The intermediate transfer belt cleaning blade 49 that is supported by the cleaning support member 56 is made of urethane rubber showing a hardness H2 of JIS-A90 degrees, which is higher than the hardness H1 of the intermediate transfer belt 10, a thickness of 2 mm, a free length of 6.5 mm and an axial length L6 of 351 mm. The intermediate transfer belt cleaning blade 49 contacts the intermediate transfer belt 10 to counter the rotary motion of the latter. While the contact angle of the intermediate transfer belt cleaning blade 49 relative to the surface of the intermediate transfer belt 10 is not subjected to any particular limitations, an excellent cleaning effect could be achieved when the intermediate transfer belt cleaning blade 49 was brought into contact with the intermediate transfer belt 10 at a contact angle of 20° under contact pressure of 1.2 kgf.

Cleaning blade seal members 52 are respectively fitted to the opposite ends of the intermediate transfer belt cleaning blade 49. The cleaning blade seal members 52 are made of PORON ML-32 available from INOAC Corporation (hardness: not greater than 10 degrees when reduced to JIS-A). The effect of absorbing the liquid carrier at the opposite ends of the intermediate transfer belt cleaning blade 49 is improved when the cleaning blade seal members 52 are made to operate as oil absorbing members. Each of the cleaning blade seal members 52 is made to extend upstream from the contact position of the intermediate transfer belt cleaning blade 49 and the intermediate transfer belt 10 in the sense of rotation of the intermediate transfer belt 10 and the extending part is tapered at the side thereof close to the intermediate transfer belt cleaning blade 49 to prevent any liquid ring from being produced.

Since the cleaning blade seal members 52 are made to extend upstream from the contact position of the intermediate transfer belt cleaning blade 49 and the intermediate transfer belt 10 in the sense of rotation of the intermediate transfer belt 10, the cleaning support member 56 is made higher than at the opposite ends than at the middle part thereof to support the cleaning blade seal members 52. The arrangement of a cleaning support member 56 of Example 2 may be applied to Example 1.

In Example 2, the axial length L2 of the intermediate transfer belt cleaning blade 49, the axial length L1 of the follower roller 13, the axial length L7 of the intermediate transfer belt 10 and the axial length L3 of the cleaning blade seal members 52 are made to show the relationships of L1>L2, L1<L2+2L3, L7>L1, L7>L2 and L7<L2+2L3. The intermediate transfer belt cleaning blade 49 can be pressed strongly against the intermediate transfer belt 10 to improve the cleaning effect by using the follower roller 13 as backup roller when L1>L2. Any liquid ring is prevented from being produced at the ends of the intermediate transfer belt cleaning blade 49 and any liquid carrier is prevented from flowing to the rear surface side of the intermediate transfer belt 10 to consequently prevent color mixing from taking place when L1<L2+2L3. Additionally, the liquid carrier and the toner at the opposite edges of the intermediate transfer belt 10 where no backup roller is provided can be removed when L7>L1, L7>L2 and L7<L2+2L3.

The hardness H1 of the intermediate transfer belt 10, the hardness H2 of the intermediate transfer belt cleaning blade 49 and the hardness H3 of the cleaning blade seal members 52 are made to show the relationships of H2>H1 and H1>H3. With this arrangement, the cleaning blade seal members 52 are pressed and deformed to tightly adhere to the opposite ends of the intermediate transfer belt 10 where no backup roller is provided to prevent any leakage of liquid and clean the opposite ends, while the intermediate transfer belt cleaning blade 49 cleans the surface of the intermediate transfer belt 10 by means of its edge.

The lengths and the widths of the component members of the transfer device having the intermediate transfer belt cleaning unit 17 of Example 2 are listed in Table 2 below.

TABLE 2

| Member | Axial length or width |
|---|---|
| follower roller L1 | 367 mm |
| intermediate transfer belt cleaning blade L2 | 351 mm |
| cleaning blade seal members L3 | 15 mm |
| intermediate transfer belt L7 | 374 mm |

Figure 12:
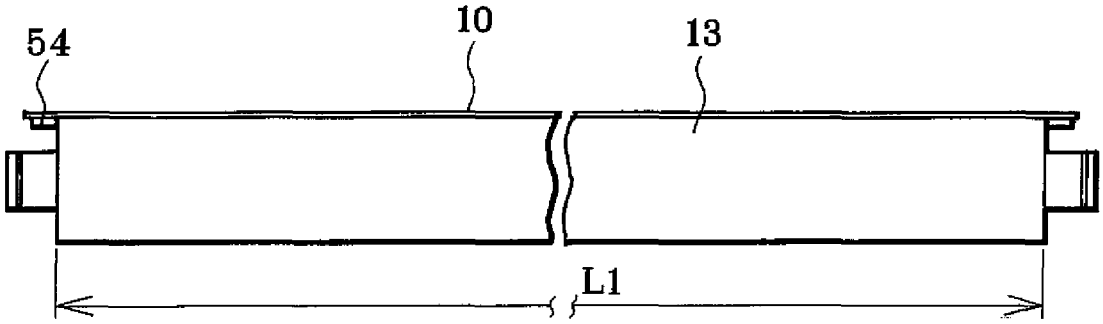
FIG. 12 is a schematic cross-sectional view of the transfer belt cleaning unit of Example 3 of a transfer device according to the present invention.
Figure 13:
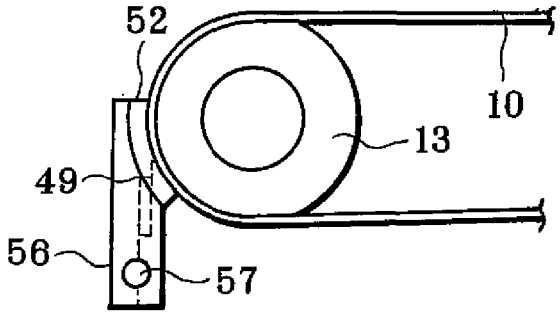
FIG. 13 is a schematic cross-sectional view of the transfer belt cleaning unit of FIG. 12.
Figure 14:
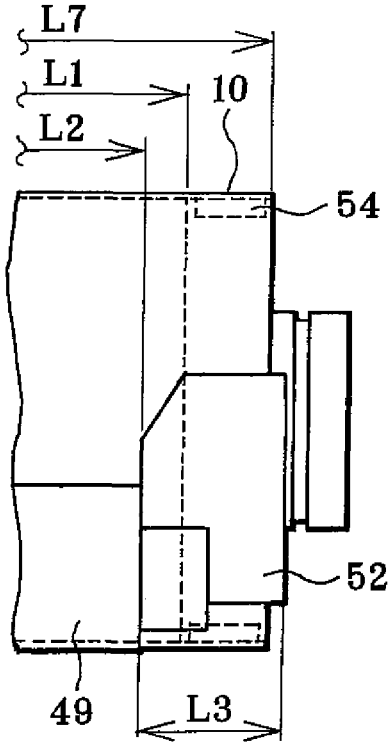
FIG. 14 is a schematic cross-sectional view of the transfer belt cleaning unit of FIG. 12.

FIGS. 12 through 14 are schematic illustrations of a transfer device according to the present invention and having an intermediate transfer belt cleaning unit 17 of Example 3.

The transfer device having the intermediate transfer belt cleaning unit 17 of Example 3 is not provided with pulleys 55 that are meandering preventing members, while the transfer device having the intermediate transfer belt cleaning unit 17 of Example 1 and that of Example 2 are provided with pulleys 55. In Example 3, beads 54 that operate as meandering limiting members are bonded respectively to the lateral edges of the intermediate transfer belt 10 at the rear surface side thereof. The beads 54 are made of urethane rubber and have a thickness of 1.5 mm and a width of 5.5 mm. As the intermediate transfer belt 10 is shifted sideway to meander while it is running, the beads 54 fitted to the intermediate transfer belt 10 contact the surface of the large diameter roller main body of the follower roller 13 along the respective lateral edges thereof to limit the meanders of the intermediate transfer belt 10.

While no intermediate transfer belt cleaning roller 50 is provided for the Example 3 illustrated in FIG. 13, an intermediate transfer belt cleaning roller 50 may be provided as in the case of Example 1.

In Example 3, the intermediate transfer belt cleaning blade 49 and the cleaning blade seal members 52 are supported by a cleaning support member 56 that is made of metal. The cleaning support member 56 is by turn rotatably supported by pins 57 such that it can be removably brought into contact with the intermediate transfer belt 10. The cleaning support member 56 is provided with an urging means (not shown) such as a spring to press the intermediate transfer belt cleaning blade 49 and the cleaning blade seal members 52 against the surface of the intermediate transfer belt 10.

The intermediate transfer belt cleaning blade 49 that is supported by the cleaning support member 56 is made of urethane rubber showing a hardness H2 of JIS-A90 degrees, which is higher than the hardness H1 of the intermediate transfer belt 10, a thickness of 2 mm, a free length of 6.5 mm and an axial length L6 of 351 mm. The intermediate transfer belt cleaning blade 49 contacts the intermediate transfer belt 10 to counter the rotary motion of the latter. While the contact angle of the intermediate transfer belt cleaning blade 49 relative to the surface of the intermediate transfer belt 10 is not subjected to any particular limitations, an excellent cleaning effect could be achieved when the intermediate transfer belt cleaning blade 49 was brought into contact with the intermediate transfer belt 10 at a contact angle of 20° under contact pressure of 1.2 kgf.

Cleaning blade seal members 52 are respectively fitted to the opposite ends of the intermediate transfer belt cleaning blade 49. The cleaning blade seal members 52 are made of PORON ML-32 available from INOAC Corporation (hardness: not greater than 10 degrees when reduced to JIS-A). The effect of absorbing the liquid carrier at the opposite ends of the intermediate transfer belt cleaning blade 49 is improved when the cleaning blade seal members 52 are made to operate as oil absorbing members. Each of the cleaning blade seal members 52 is made to extend upstream from the contact position of the intermediate transfer belt cleaning blade 49 and the intermediate transfer belt 10 in the sense of rotation of the intermediate transfer belt 10 and the extending part is tapered at the side thereof close to the intermediate transfer belt cleaning blade 49 to prevent any liquid ring from being produced.

Since the cleaning blade seal members 52 are made to extend upstream from the contact position of the intermediate transfer belt cleaning blade 49 and the intermediate transfer belt 10 in the sense of rotation of the intermediate transfer belt 10, the cleaning support member 56 is made higher at the opposite ends than at the middle part thereof to support the cleaning blade seal members 52.

In Example 3, the axial length L2 of the intermediate transfer belt cleaning blade 49, the axial length L1 of the follower roller 13, the axial length L7 of the intermediate transfer belt 10 and the axial length L3 of the cleaning blade seal members 52 are made to show the relationships of L1>L2, L1<L2+2L3, L7>L1, L7>L2 and L7<L2+2L3. The intermediate transfer belt cleaning blade 49 can be pressed strongly against the intermediate transfer belt 10 to improve the cleaning effect by using the follower roller 13 as backup roller when L1>L2. Any liquid ring is prevented from being produced at the ends of the intermediate transfer belt cleaning blade 49 and any liquid carrier is prevented from flowing to the rear surface side of the intermediate transfer belt 10 to consequently prevent color mixing from taking place when L1<L2+2L3. Additionally, the liquid carrier and the toner at the opposite edges of the intermediate transfer belt 10 where no backup roller is provided can be removed when L7>L1, L7>L2 and L7<L2+2L3.

The hardness H1 of the intermediate transfer belt 10, the hardness H2 of the intermediate transfer belt cleaning blade 49 and the hardness H3 of the cleaning blade seal members 52 are made to show the relationships of H2>H1 and H1>H3. With this arrangement, the cleaning blade seal members 52 are pressed and deformed to tightly adhere to the opposite ends of the intermediate transfer belt 10 where no backup roller is provided to prevent any leakage of liquid and clean the opposite ends, while the intermediate transfer belt cleaning blade 49 cleans the surface of the intermediate transfer belt 10 by means of its edge.

The lengths and the widths of the component members of the transfer device having the intermediate transfer belt cleaning unit 17 of Example 3 are listed in Table 3 below.

TABLE 3

| Member | Axial length or width |
|---|---|
| follower roller L1 | 367 mm |
| intermediate transfer belt cleaning blade L2 | 351 mm |
| cleaning blade seal members L3 | 15 mm |
| intermediate transfer belt L7 | 374 mm |

What is claimed is:

1. A transfer device comprising:

a transfer belt that carries a transferred image;

a roller around which the transfer belt is wound;

a transfer belt cleaning blade to be brought into contact with the roller by way of the transfer belt and clean the transfer belt; and a cleaning blade seal member that is arranged at the opposite lateral end of the transfer belt cleaning blade and seal the transfer belt cleaning blade, the roller, the transfer belt cleaning blade and the cleaning blade seal member being arranged to satisfy relationships of L1>L2 and L1<L2+2L3 (L1: a length of the roller in an axial direction, L2: a length of the transfer belt cleaning blade in the axial direction, L3: a length of the cleaning blade seal member in the axial direction).

2. The device according to claim 1, further comprising: a meandering preventing member that is arranged at the opposite axial end of the roller and prevent the transfer belt from meandering.

3. The device according to claim 1, wherein the transfer belt is arranged to satisfy relationships of L7>L1, L7>L2, and L7<L2+2L3 (L7: a length of the transfer belt in the axial direction).

4. The device according to claim 1, further comprising:

a transfer belt cleaning roller to be brought into contact with the roller by way of the transfer belt and apply a cleaning bias;

a cleaning roller cleaner to be brought into contact with the transfer belt cleaning roller and clean the transfer belt cleaning roller; and a roller cleaner seal member that is arranged at the opposite end of the cleaning roller cleaner in the axial direction of the transfer belt cleaning roller and seal the cleaning roller cleaner, wherein the transfer belt cleaning roller, the cleaning roller cleaner, and the roller cleaner seal member being arranged to satisfy relationships of L4>L6, and L4<L1+2L5 (L4: a length of the transfer belt cleaning roller in the axial direction, L5: a length of the roller cleaner seal member in the axial direction, L6: a length of the cleaning roller cleaner in the axial direction).

5. The device according to claim 1, wherein the roller cleaner seal member and the cleaning blade seal member are arranged to satisfy a relationship of L3>L5.

6. The device according to claim 1, further comprising: a cleaning support member that supports the transfer belt cleaning blade and the cleaning blade seal member and urges the transfer belt cleaning blade and the cleaning blade seal member to bring them into contact with the transfer belt.

7. The device according to claim 1, wherein a hardness H1 of the transfer belt, a hardness H2 of the transfer belt cleaning blade, and a hardness H3 of the cleaning blade seal member have relationships of H2>H1 and H1>H3.

8. The device according to claim 1, wherein the roller is a tension roller that applies tension to the transfer belt.

9. An image forming apparatus comprising:

a image carrier drum that carries an image developed by a liquid developer containing toner and carrier liquid;

a transfer belt that receives the image as transferred from the image carrier drum;

a transfer unit that transfers the image on the transfer belt onto a transfer member;

a roller around which the transfer belt is wound;

a transfer belt cleaning blade to be brought into contact with the roller by way of the transfer belt and clean the transfer belt; and a cleaning blade seal member that is arranged at the opposite end of the transfer belt cleaning blade and seal the transfer belt cleaning blade; wherein the image carrier drum, the transfer belt, the transfer belt cleaning blade and the cleaning blade seal member being arranged to satisfy relationships of L8>L7, L1>L2, and L1>L2+2L3 (L1: a length of the roller in the axial direction, L2: a length of the transfer belt cleaning blade in the axial direction, L3: a length of the cleaning blade seal member in the axial direction, L7: a length of the transfer belt in the axial direction, L8: a length of the image carrier drum in the axial direction).

10. The apparatus according to claim 9, wherein the transfer belt is arranged to satisfy relationships of L7>L1, L7>L2 and L7>L2+2L3 (L7: a length of the transfer belt in the axial direction).

11. The apparatus according to claim 9, further comprising:

a belt cleaning roller to be brought into contact with the roller by way of the transfer belt and apply a cleaning bias;

a cleaning roller cleaner to be brought into contact with the transfer belt cleaning roller and clean the transfer belt cleaning roller; and a roller cleaner seal member that is arranged at the opposite end of the cleaning roller cleaner and seal the cleaning roller cleaner, wherein the transfer belt cleaning roller, the cleaning roller cleaner, the roller cleaner seal member are arranged to satisfy relationships of L4>L6, and L4<L6+2L5 (L4: a length of the transfer belt cleaning roller in the axial direction, L5: a length of the roller cleaner seal member in the axial direction, L6: a length of the cleaning roller cleaner in the axial direction).

12. The apparatus according to claim 9, wherein the roller cleaner seal member is arranged to satisfy the relationship of L3>L5.

13. The apparatus according to claim 9, further comprising;

a cleaning support member that supports the transfer belt cleaning blade and the cleaning blade seal member and urges the transfer belt cleaning blade and the cleaning blade seal member to bring them into contact with the transfer belt.

14. The apparatus according to claim 9, wherein a hardness H1 of the transfer belt, a hardness H2 of the transfer belt cleaning blade and a hardness H3 of the cleaning blade seal member have relationships of H2>H1 and H1>H3.

15. The apparatus according to claim 9, wherein the roller is a tension roller that applies tension to the transfer belt.

* * * * *